US010233883B2

(12) United States Patent
Lenzi et al.

(10) Patent No.: US 10,233,883 B2
(45) Date of Patent: Mar. 19, 2019

(54) FUEL INJECTOR

(71) Applicant: Continental Automotive GmbH, Hannover (DE)

(72) Inventors: Francesco Lenzi, Leghorn (IT); Stefano Filippi, Castel' Anselmo Collesalvetti (IT); Mauro Grandi, Leghorn (IT); Valerio Polidori, Leghorn (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 524 days.

(21) Appl. No.: 14/598,435

(22) Filed: Jan. 16, 2015

(65) Prior Publication Data

US 2015/0204288 A1 Jul. 23, 2015

(30) Foreign Application Priority Data

Jan. 16, 2014 (EP) ..... 14151425

(51) Int. Cl.
*F02M 51/06* (2006.01)

(52) U.S. Cl.
CPC ..... *F02M 51/061* (2013.01); *F02M 51/066* (2013.01); *F02M 51/0685* (2013.01); *F02M 2200/22* (2013.01); *F02M 2200/30* (2013.01)

(58) Field of Classification Search
CPC ..... F02M 51/061; F02M 51/066; F02M 51/0685; F02M 2200/22; F02M 2200/30; Y10S 239/90

(Continued)

(56) References Cited

U.S. PATENT DOCUMENTS 4,490,975 A * 1/1985 Yaeger ..... H01H 61/0107 337/140
4,774,485 A * 9/1988 Dietrich ..... H01H 51/2209 335/230

(Continued)

FOREIGN PATENT DOCUMENTS

DE 19849210 A1 4/2000 ..... F02M 51/06
DE 102011016463 A1 10/2012 ..... A63B 23/04

(Continued)

OTHER PUBLICATIONS

European Office Action, Application No. 14151425.7, 4 pages, dated Jun. 13, 2016.

(Continued)

*Primary Examiner* — Steven J Ganey
(74) *Attorney, Agent, or Firm* — Slayden Grubert Beard PLLC

(57) ABSTRACT

A fuel injector includes a fuel valve including a valve needle and a valve seat for controlling a flow of fuel through the injector. The fuel injector also includes an electromagnetic actuator with a solenoid and an armature that lifts the valve needle from the valve seat in an opening direction while the solenoid is electrically energized. The fuel injector also includes a housing in which the valve needle and the armature are received such that they are displaceable in reciprocating fashion with respect to the housing and with respect to one another. A spring is arranged between the armature and the housing, for pushing the armature against the valve needle in the opening direction, wherein the spring provides a hysteretic relationship between force and displacement.

8 Claims, 4 Drawing Sheets

(58) Field of Classification Search
USPC ..... 239/585.1–585.4, 585.5, 900
See application file for complete search history.

(56) References Cited

U.S. PATENT DOCUMENTS

| | | | | |
|---|---|---|---|---|
| 6,367,769 | B1 | 4/2002 | Reiter | 251/129.19 |
| 6,808,134 | B2 | 10/2004 | Noller et al. | 239/585.1 |
| 7,721,713 | B2 * | 5/2010 | Hayatani | F02M 51/0685 123/467 |
| 2012/0261499 | A1 * | 10/2012 | Dames | H01F 7/122 239/585.1 |
| 2014/0110508 | A1 * | 4/2014 | Dames | H01F 7/1646 239/585.1 |

FOREIGN PATENT DOCUMENTS

| | | | | |
|---|---|---|---|---|
| EP | 1820959 | A1 | 8/2007 | F02M 51/06 |
| EP | 1845254 | A1 | 10/2007 | F02M 51/06 |
| EP | 2706221 | A1 | 3/2014 | F02M 51/06 |
| WO | 02/12709 | A1 | 2/2002 | F02M 51/06 |

OTHER PUBLICATIONS

European Search Report, Application No. 14151425.7, 4 pages, dated May 14, 2014.

* cited by examiner

FUEL INJECTOR

CROSS-REFERENCE TO RELATED APPLICATIONS

This application claims priority to EP Patent Application No. 14151425.7 filed Jan. 16, 2014. The contents of which are incorporated herein by reference in their entirety.

TECHNICAL FIELD

The present invention relates to a fuel injector. More specifically, present invention relates to a fuel injector for injecting fuel into an internal combustion engine, preferably in a motor vehicle.

BACKGROUND

A combustion engine, especially of the piston type, may use a fuel injector for injecting fuel into a combustion chamber. The fuel injector comprises a fuel valve and an electric actuator for the valve. The valve comprises a valve seat and a valve needle for controlling the flow of the fuel. The electric actuator comprises a solenoid and an armature for lifting the valve needle from the valve seat while the solenoid is electrically energized.

When the solenoid is no longer energized, the valve needle of the fuel valve is returned to the valve seat by means of an elastic element and a flow of fuel is stopped. However, there may be an unintended flow of fuel through the injector after the valve needle has impacted on the valve seat. The valve needle of the injector may bounce back from the valve seat and reopen the fuel valve immediately after its closing, which is commonly referred to as "bounce".

In particular in the case of injectors having the armature axially displaceable with respect to the valve needle, also a reopening of the injector up to 2 milliseconds after the impact may take place, which phenomenon is called "post injection". It may be caused by an interaction between the valve needle and the armature when the armature returns to a rest position in contact with the valve needle after decoupling from the valve needle when the latter impacts on the valve seat.

A prevention of uncontrolled and unwanted fluid flow through the injector has thus far been addressed with a flow-restrictive device upstream the valve. The device is commonly called anti bounce disc. It serves as a dynamic brake that chokes the main fuel channel, thus reducing the speed of movement of the valve needle when it approaches the valve seat. The anti-bounce disc has the disadvantage that it is within the hydraulic flow path of the injected fuel and causes a hydraulic resistance to the fuel. With the anti-bounce disk, the bounce effect is smaller but the injector needs more time to close and the maximum operative hydraulic pressure is significantly reduced.

There are also other approaches for bounce avoiding, but they are generally not effective for reduction or elimination of post injection.

SUMMARY

One embodiment provides a fuel injector, comprising a fuel valve, comprising a valve needle and a valve seat, for controlling a flow of fuel through the injector; an electromagnetic actuator with a solenoid and an armature which is operable to lift the valve needle from the valve seat in an opening direction while the solenoid is electrically energized; a housing in which the valve needle and the armature are received such that they are displaceable in reciprocating fashion with respect to the housing and with respect to one another; and a spring between the armature and the housing, for pushing the armature against the valve needle in the opening direction, wherein the spring is configured to provide a hysteretic relationship between force and displacement.

In a further embodiment, the spring comprises a pseudoelastic material.

In a further embodiment, the spring comprises a shape memory alloy.

In a further embodiment, the spring material is adapted to transform, at least in part, into martensitic structure upon spring compression and into austenitic structure upon spring release.

In a further embodiment, the spring is adapted to return no more than 50% of its compression energy into kinetic energy.

In a further embodiment, the fuel injector further comprises a calibration spring for biasing the valve needle in a direction opposite to the opening direction.

In a further embodiment, the valve needle comprises a seat element for resting on the valve seat.

In a further embodiment, the valve needle comprises a tubular shaft and a ball-shaped seat element which is located between the valve seat and the tubular shaft.

In a further embodiment, the fuel injector further comprises a flow restrictive device upstream the valve needle.

BRIEF DESCRIPTION OF THE DRAWINGS

Example embodiments of the invention are explained in more detail below with respect to the enclosed figures, in which.

DETAILED DESCRIPTION

Figure 1:
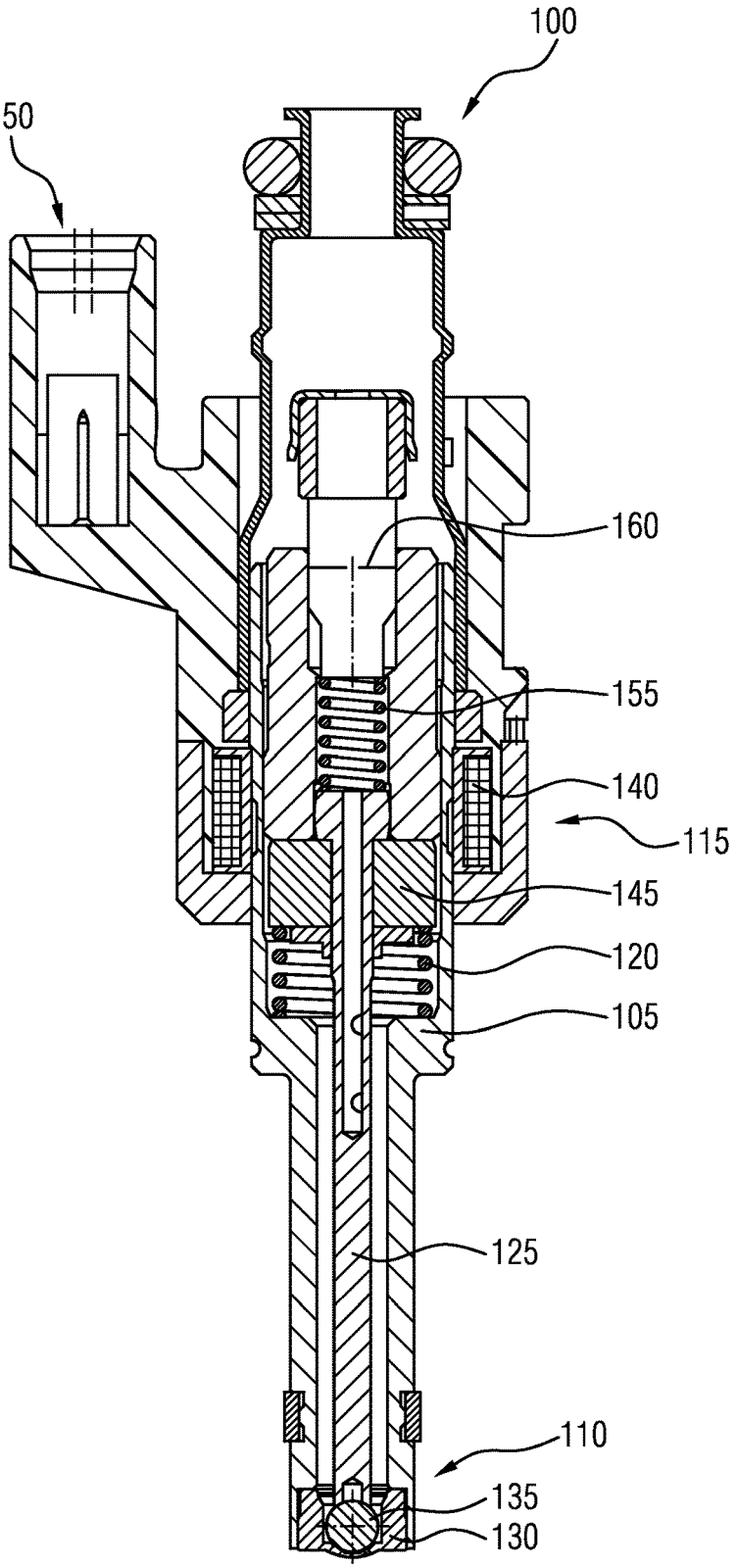
FIG. 1 shows a fuel injector in a longitudinal section view.

Embodiments of present invention provide a fuel injector that permits improved suppression of unwanted or uncontrolled fluid flow through the injector.

A fuel injector is specified. It comprises a fuel valve with a valve needle and a valve seat for controlling a flow of fuel through the injector.

The fuel injector further comprises an electromagnetic actuator with a solenoid and an armature. The armature is operable to lift the valve needle from the valve seat in an opening direction while the solenoid is electrically energized.

In addition, the fuel injector comprises a housing. The valve needle and the armature are received in the housing—more specifically in a cavity of the housing—such that they are displaceable in reciprocating fashion with respect to the housing and with respect to one another. The valve needle and the armature are in particular axially displaceable along a longitudinal axis of the housing.

Furthermore, the fuel injector comprises a spring that is situated between the armature and the housing, for pushing the armature against the valve needle in the opening direction. The spring may sometimes also be denoted as an armature recall spring.

In case of an inward opening fuel valve, the opening direction is a direction away from the valve seat. An inward opening fuel valve is understood to be a fuel valve wherein the valve needle is displaced opposite to a direction of the fuel flow for opening the valve.

The spring is configured to provide a hysteretic relationship between force and displacement. In particular, the spring is in this way operable to dissipate a portion of kinetic energy which is transferred from the armature to the spring to compress the spring.

In one embodiment, the valve needle comprises an armature retainer which limits the axial displacement of the armature with respect to the valve needle in the direction away from the valve seat. In this case, the armature is preferably operable to lift the valve needle from the valve seat by means of taking the valve needle with it through a form-fit engagement with the armature retainer when the armature travels axially away from the valve seat with respect to the housing. The spring is preferably operable to press the armature against the armature retainer.

When the valve needle returns into contact with the valve seat during the closing transient of the fuel valve, the armature is in particular operable to continue travelling with respect to the valve needle and to the housing so that the form-fit engagement with the armature retainer is released. The spring is operable to dampen said travelling and subsequently push the armature back into form-fit engagement with the armature retainer.

With advantage, both post injection and bouncing after the valve needle has impacted on the valve seat may be avoided or largely reduced in the fuel injector according to the present disclosure. In particular, the risk for a needle bounce may be particularly small due to the armature which can decouple from the valve needle upon its impact on the valve seat. Thus, the impulse of the armature is not imposed onto the valve needle when the valve closes. The subsequent impact of the armature on the armature retainer may advantageously be particularly soft due to energy dissipation by the hysteretic spring. Strain of the valve as well as bouncing and reopening effects may thus be reduced. This may help to prevent degraded performance of the fuel injector or of a combustion engine into which a flow of fuel through the injector is directed. The given behaviour may be provided over a large operating pressure range. An additional advantage may be that in the opening phase of the valve, an overshoot of the valve needle, when movement of the valve needle exceeds movement of the armature, may be reduced. Still a further advantage may be that the armature can go back earlier to its original position—in particular in form-fit engagement with the armature retainer—in a closed state of the fuel valve. An oscillation of the armature around its original position may also be reduced. This is especially useful in cases of multiple injections in rapid succession, e.g. during one stroke of a piston engine.

The spring may comprise a pseudoelastic material. Pseudoelasticity, sometimes called superelasticity, is an elastic (reversible) response to an applied stress, caused by a phase transformation between the austenitic and martensitic phases of a crystal. For instance, when using a pseudoelastic alloy, no change in temperature may be required for the alloy to recover its initial shape after deformation.

The spring may comprise a shape memory alloy (SMA). SMAs have demonstrated energy dissipation capabilities, large elastic strain capacity, hysteretic damping, good high and low cycle fatigue resistance and excellent corrosion resistance.

In the cases of pseudoelastic materials or shape memory alloys, the spring material may be adapted to transform, at least in part, into martensitic structure upon spring compression and into austenitic structure upon spring release. By virtue of this transition, compression energy may be used for structure change, thus enabling longer term storing of energy, which can be used for the hysteretic bouncing or dampening.

Nickel titanium may be used as an exemplary pseudoelastic alloy. Nickel titanium, also known as nitinol, is a metal alloy of nickel and titanium, where the two elements are in particular present in roughly equal atomic percentages.

In an especially preferred embodiment, the spring is adapted to return no more than 50% of its compression energy into kinetic energy. This way, the closing motion of the armature is cushioned by a spring force less than half of which is later returned to the armature in kinetic energy. The rest of the energy may eventually be transformed into heat and/or sound waves. As the absolute amount of dissipated energy is low, it is expected that the heat and/or sound will not affect the injector in a negative way.

In one embodiment, the valve needle comprises a seat element for resting on the valve seat. The seat element may be ball-shaped. This way, a simple and reliable valve may be employed.

In another embodiment, the valve needle comprises a tubular shaft and the ball-shaped seat element is located between the valve seat and the tubular shaft. The valve may thus be sturdier or less prone to leaking.

In another embodiment, a flow restrictive device upstream the valve needle is comprised by the fuel injector. Bouncing of the needle or tube and ball on the valve seat may thus be further reduced.

FIG. 1 shows a fuel injector 100. The fuel injector 100 comprises a fuel valve 110, an electromagnetic actuator 115 and a spring 120. The fuel valve 110 comprises a valve needle 125 and a valve seat 130.

In the embodiment shown in FIG. 1, the valve needle 125 comprises an at least partially hollow, tubular shaft through which fuel may pass. Between the tube and the valve seat 130, a ball-shaped seat element 135 of the valve needle 125 is arranged. In another embodiment, the valve needle 125 comprises a solid shaft which may, in one variant, rest directly on the valve seat 130. Either way, the fuel valve 110 is configured to inhibit a flow of fuel through the fuel injector 100 when the valve needle 125 is pressed down on the valve seat 130. For permitting fuel to pass through the fuel valve 110, the valve needle 125 is lifted in an opening direction away from the valve seat 130.

The electromagnetic actuator 115 of FIG. 1 comprises a solenoid 140 and an armature 145. The armature 145 and the valve needle 125 are arranged in a cavity of a housing 105 of the fuel injector 100. Electrical leads of the solenoid 140 are preferably connected to an optional connector 150 that may be attached to the housing 105.

The valve needle 125 and the housing 105 share a common longitudinal axis. The armature 145 and the valve needle 125 are received in the housing 105 such that they are axially displaceable in reciprocating fashion with respect to the housing 105 and with respect to one another. Displacement of the armature 145 with respect to the valve needle 125 in the opening direction is limited by an armature retainer of the valve needle 125. In the present embodiment, the armature retainer is a collar at an end of the shaft remote from the seat element 135.

When a current flows through the solenoid 140, an electromagnetic field is created that pulls the armature 145 in the opening direction, i.e. in the present case of an inward opening valve in direction away from valve seat 130. The valve needle 125 is engaged with the armature 145 via a form-fit connection with the armature retainer so that said movement of armature 145 effects an opening of the fuel valve 110.

The spring 120 is disposed between the housing 105 and the armature 145 and exerts a lifting force on the armature 145 that pushes the armature 145 in the opening direction to promote the form-fit connection with the armature retainer.

Figure 3:
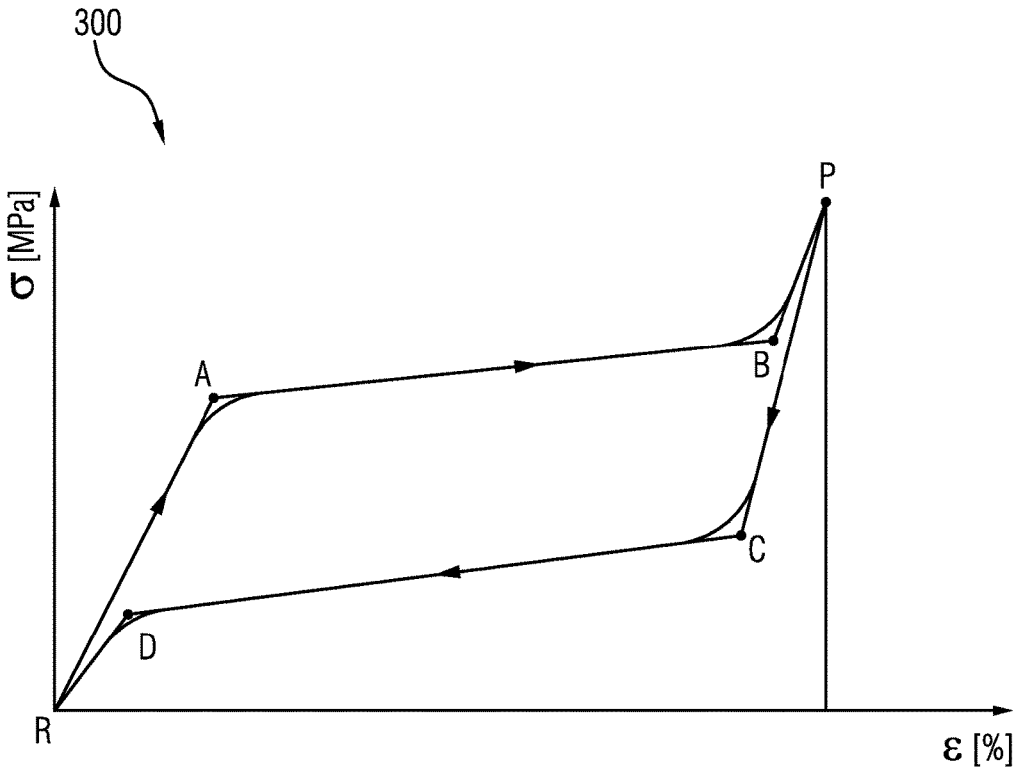
FIG. 3 shows a relationship between strain and force in the spring of the injector of FIGS. 1 and 2.

As will be further explained in more detail with respect to FIG. 3, the spring 120 is configured to provide a hysteretic relationship between force and displacement. This feature distinguishes spring 120 from an ordinary spring with a linear relationship between force and displacement.

In the shown, preferred embodiment there is also provided a calibration spring 155 for pressing the valve needle 125 down towards the valve seat 130 in a direction opposite to the opening direction. This ensures a leak-tight closing of fuel valve 110 when the electric actuator 115 is not operated and the solenoid 140 is not energized.

There may also be provided an optional flow restrictive device 160, preferably upstream the valve 110. The flow restrictive device 160 may comprise a disc with a predetermined through-hole. In one embodiment, a diameter of the through-hole is 20% or less, preferably 10% or less, of a diameter of the disc.

Figure 2:
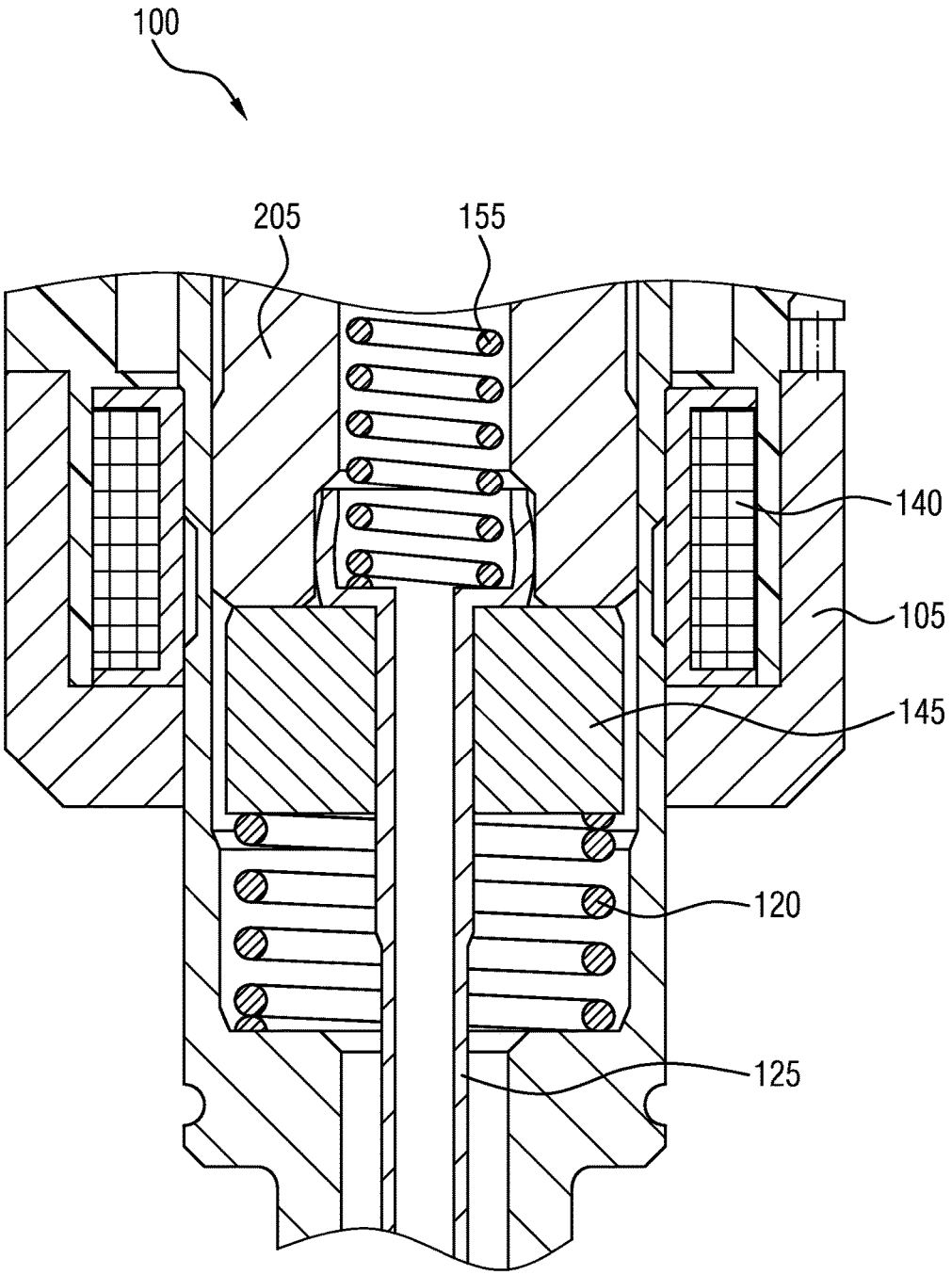
FIG. 2 shows a detail of the fuel injector of FIG. 1 in a longitudinal section view.

FIG. 2 shows a detail of the fuel injector 100 of FIG. 1. It can be seen that the armature 145 is an item separate from the valve needle 125 and that the two are engaged such that an upward movement of the armature 145 away from the valve seat 130 is directly transferred to the valve needle 125 by means of the form-fit engagement with the collar. The form-fit connection is releasable so that the armature 145 is displaceable independent from a movement of the valve needle 125 in the direction opposite to the opening direction, i.e. towards the valve seat 130 in the present case.

When the fuel injector 100 is idle and the electromagnetic actuator 115 is not operated, calibration spring 155 presses the valve needle 125 towards the valve seat 130 and valve 130 is in a closed state. At the same time, spring 120 exerts a force smaller than that of calibration spring 155 on the armature 145 to move it up in a direction away from valve seat 130 until the armature 145 rests against an upper portion—the collar representing the armature retainer—of the valve needle 125.

When the fuel valve 110 is to be opened, an electric current is effected through the solenoid 140 so that the armature 145 is magnetically moved upwards against the force of calibration spring 145 until the armature 145 rests against a stopper 205, which is attached to the housing 105. This movement may lie in the range of one to two hundred micrometres, for example. In one embodiment, spring 120 is relaxed during this movement. It is also conceivable that the spring 120 pushes the armature 145 in the opening direction also when it is in contact with the stopper 205.

At the end of an injection phase, the current through solenoid 140 is turned off and the magnetic field collapses so that the armature 145 is no longer held up against the force of calibration spring 155. Calibration spring 155 therefore effects a movement of the valve needle 125 down towards valve seat 130, which movement is also transferred onto armature 145. When the valve needle 125 or, more specifically, the seat element 135 rests against the valve seat 130, the armature 145 continues travelling towards valve seat 130 due to its inertia, thereby disengaging from the collar of the valve needle 125. During this movement of armature 145, spring 120 is compressed. When the armature 145 eventually comes to a standstill, spring 120 uses the energy of its previous compression to return armature 145 upwards away from valve seat 130 until the armature 145 engages with the upper portion of valve needle 125, again. From this position, the injector 100 is ready for another injection cycle.

The spring 120 is configured to only return a part of the energy that was used for its compression into driving the armature 145 back up away from valve seat 130. The rest of the energy is used for a structural change—in particular a phase transition between two different crystal structures—of the material of spring 120 and/or eventually dissipated. To effect such energy allocation, the spring 120 provides a hysteretic relationship between force and displacement.

FIG. 3 shows a relationship between strain and force in the spring 120 of the injector 100 of FIGS. 1 and 2. The horizontal axis shows a strain $\varepsilon$ and the vertical axis a stress $\sigma$ of the material from which spring 120 is made. The strain $\varepsilon$ corresponds to a physical compression, while the stress $\sigma$ corresponds to a reacting force of spring 120. Unlike an ordinary linear spring, the relationship between strain $\varepsilon$ and stress $\sigma$ is nonlinear and hysteretic.

Taking a spring 120 from a relaxed state R to a packed state P, the stress $\sigma$ rises steeply in a beginning phase until point A and gently in a consecutive phase until point B. After that, stress $\sigma$ rises rapidly again until the packed state P is reached. Upon expanding from point P towards point R, the stress $\sigma$ first drops steeply until a point C in which stress $\sigma$ in the spring 120 is lower than in point B. In a consecutive phase, stress $\sigma$ is reduced gently until a point D which lies lower on the stress level axis than point A. From there, stress $\sigma$ is reduced sharply again until spring 120 finally reaches point R.

To effect the spring characteristic of FIG. 3, the material spring 120 comprises pseudoelastic material like a pseudoelastic crystal or a pseudoelastic alloy. Pseudoelastic alloys belong to the larger family of shape memory alloys. When mechanically loaded, a pseudoelastic alloy deforms reversibly up to very high strains $\varepsilon$—like up to $\varepsilon$=10% —by the creation of a stress-induced phase. When the load is removed, the stress-induced phase becomes unstable and the material regains its original shape. No change in temperature is needed for the alloy to recover its initial shape.

The most common pseudoelastic alloy is an equiatomic alloy of nickel and titanium known as Nitinol, although both nickel-rich and titanium-rich alloys may be used. Other examples include copper-zinc-alloys or ternary alloys like nickel-copper-titanium or nickel-hafnium-titanium.

In the range between R and A, the material of spring 120 is austenitic and deformation is elastic. At point A the strain $\varepsilon$ leads to an at least partial state change into martensitic material. This transformation is completed at point B, beyond which elastic deformation of martensite takes place until point P. On the way back, structure of spring 120 is transformed back from martensite into austenite between points C and D. The area between points A, B, C and D corresponds to a dissipated energy of spring 120. Energy dissipation normally takes place in the shape of heat and/or sound waves.

Figure 4:
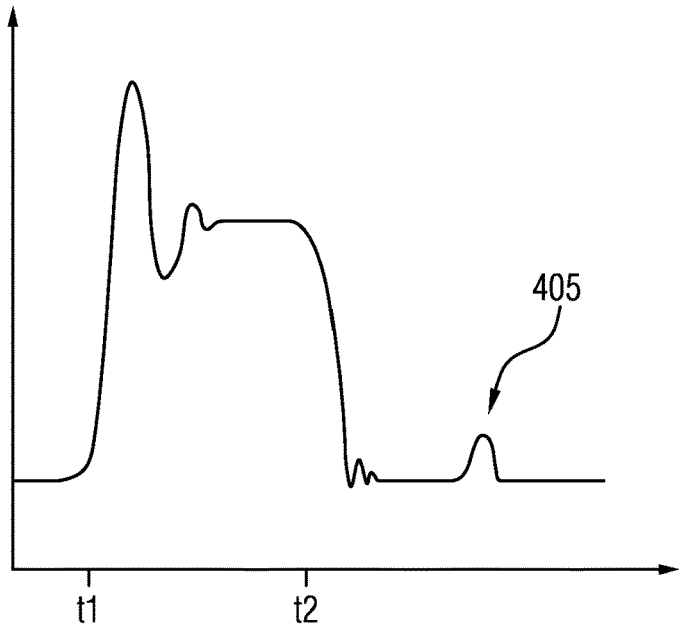
FIG. 4 shows schematic representations of the post injection and bounce effect in a known fuel injector.
Figure 4:
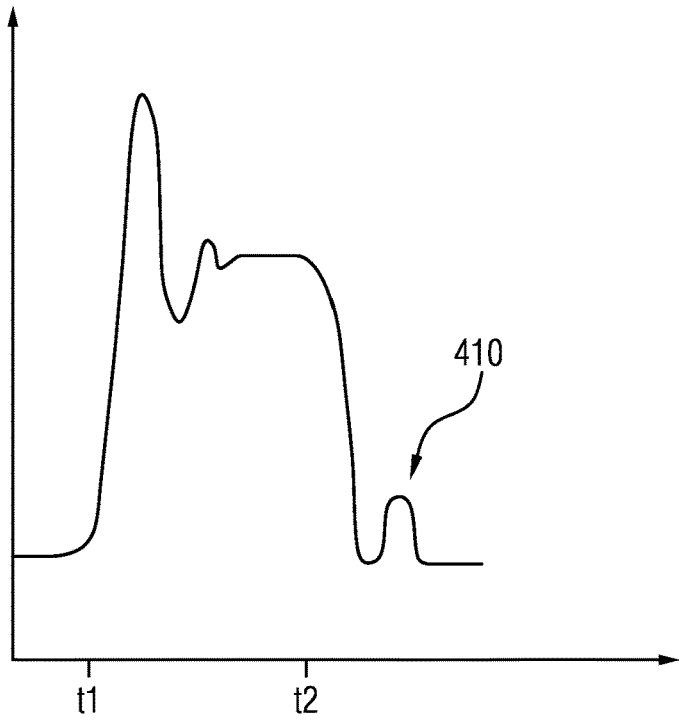

FIG. 4 shows schematic representations of effects that lead to uncontrolled and unwanted fluid flow through an injector. The above-described injector 100 sets out to minimize or prevent such effects. In an upper area of FIG. 4, the phenomena of "post injection" is shown and in a lower area the phenomenon of "bounce". In both cases, horizontal axis denotes time and vertical axis valve lifts. A solenoid for operating the armature is energized at a time T1, upon which opening starts quickly. After a settling time, the opening distance remains constant until, at a time T2, the solenoid 140 stops being energized. After that, the opening distance of the injector is reduced quickly. A post injection event 405 is a reopening of the injector that can take place up to 2 milliseconds after the valve needle 125 or seat element 135 impacts on the valve seat 130. A bounce event 410 is a reopening of the valve 110 that happens immediately after the impact upon the seat 130. The bounce is a consequence of the spring effect on the impacting components with a lack of dampening effect.

Both the post injection 405 and the bounce 410 may be significantly reduced by means of the injector 100 according to at least one of the embodiments according to the present disclosure.

What is claimed is:

1. A fuel injector, comprising:

a fuel valve comprising a valve needle and a valve seat and configured to control a flow of fuel through the injector;

an electromagnetic actuator including a solenoid and an armature and operable to lift the valve needle from the valve seat in an opening direction while the solenoid is electrically energized;

a housing in which the valve needle and the armature are received such that the valve needle and the armature are displaceable in reciprocating fashion with respect to the housing and with respect to one another; and a spring between the armature and the housing and configured to push the armature and thereby exert a force against the valve needle in the opening direction;

wherein the spring comprises a pseudoelastic material transforming at least in part to a martensitic structure upon compression and at least in part to an austenitic structure upon release and therefore has a spring rate with a hysteretic relationship between force and displacement.

2. The fuel injector of claim 1, wherein the spring comprises a shape memory alloy.

3. The fuel injector of claim 1, wherein the spring is adapted to return no more than 50% of its compression energy into kinetic energy.

4. The fuel injector of claim 1, further comprising a calibration spring that biases the valve needle in a direction opposite to the opening direction.

5. The fuel injector of claim 1, wherein the valve needle comprises a seat element configured to rest on the valve seat.

6. The fuel injector of claim 1, wherein the valve needle comprises a tubular shaft and a ball-shaped seat element located between the valve seat and the tubular shaft.

7. The fuel injector of claim 1, further comprising a flow restrictive device upstream the valve needle.

8. A fuel injector, comprising:

a fuel valve including a valve needle and a valve seat defined in a housing;

an electromagnetic actuator including a solenoid and an armature and operable to lift the valve needle from the valve seat in an opening direction by energizing the solenoid;

the valve needle and the armature movable in reciprocating fashion with respect to the housing and with respect to one another; and a spring seated against the armature and the housing at opposite ends of the spring;

wherein the spring comprises a pseudoelastic material transforming at least in part to a martensitic structure upon compression and at least in part to an austenitic structure upon release and therefore has a spring rate with a hysteretic relationship between force and displacement and the spring dampens movement of the armature with respect to the housing when the valve needle is in contact with the valve seat.

* * * * *